United States Patent [19]

Silver

[11] Patent Number: 4,490,643

[45] Date of Patent: Dec. 25, 1984

[54] STORAGE DEVICE HAVING A SEMICONDUCTOR TARGET

[75] Inventor: Robert S. Silver, Kendall Park, N.J.

[73] Assignee: RCA Corporation, New York, N.Y.

[21] Appl. No.: 145,002

[22] Filed: May 19, 1971

Related U.S. Application Data

[63] Continuation of Ser. No. 789,762, Jan. 8, 1969, abandoned.

[51] Int. Cl.[3] ..... H01J 31/58

[52] U.S. Cl. ..... 313/391; 313/395; 313/399; 315/8.51; 328/124

[58] Field of Search ..... 313/66, 65 AB, 68, 392, 313/367, 391, 366, 395, 399; 328/123, 124; 315/8.5

[56] References Cited

U.S. PATENT DOCUMENTS

| | | | |
|---|---|---|---|
| 3,523,208 | 8/1970 | Bodmer et al. | 313/367 X |
| 3,541,384 | 11/1970 | Shortes | 313/392 X |
| 3,631,294 | 12/1971 | Hofstein | 313/392 X |
| 4,302,703 | 11/1981 | Gordon | 315/13 ST |

*Primary Examiner*—Eugene R. La Roche
*Attorney, Agent, or Firm*—Eugene M. Whitacre; Dennis H. Irlbeck; Vincent J. Coughlin, Jr.

[57] ABSTRACT

An information storage device having an evacuated envelope containing writing means which is adapted to produce, in response to an input signal and by causing emission of secondary electrons, a charge pattern on a storage target disposed within the envelope. The storage target includes a semiconducting layer and a storage layer providing alternate semiconducting regions and storage regions. The semiconducting layer consists essentially of semiconductor material of substantially single conductivity type and the storage regions consist essentially of a secondary electron-emissive insulating compound of a semiconductor material. One of the two layers is interrupted and exposes portions of the other layer. A collector electrode disposed within the envelope intercepts the secondary electrons emitted by the target. The target is provided with means for applying electrical potential thereto and extracting signals therefrom.

23 Claims, 16 Drawing Figures

Fig. 13
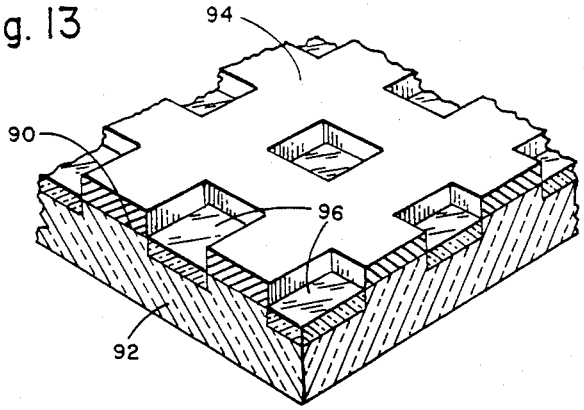
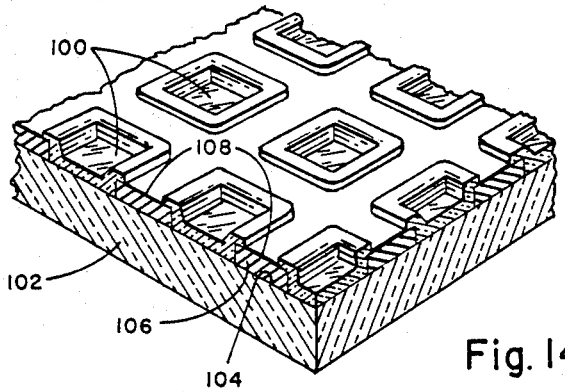
Fig. 14
Fig. 15
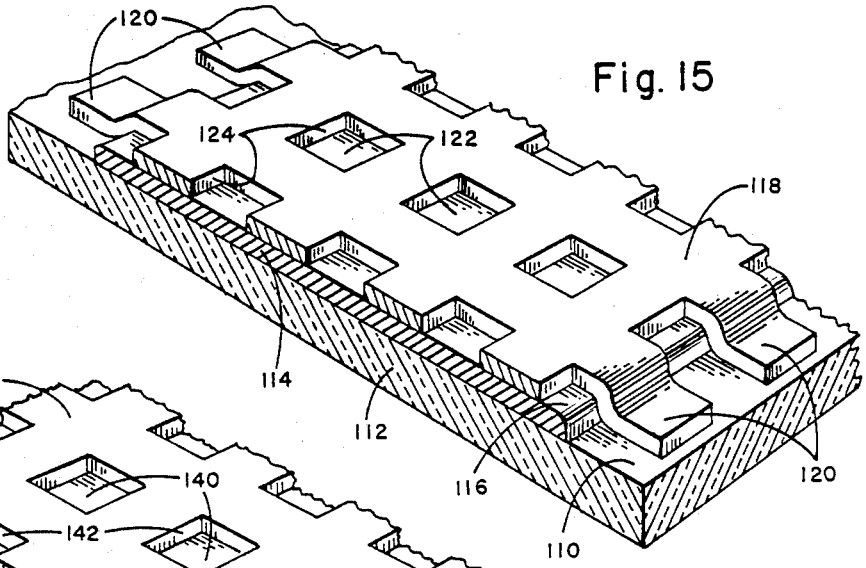
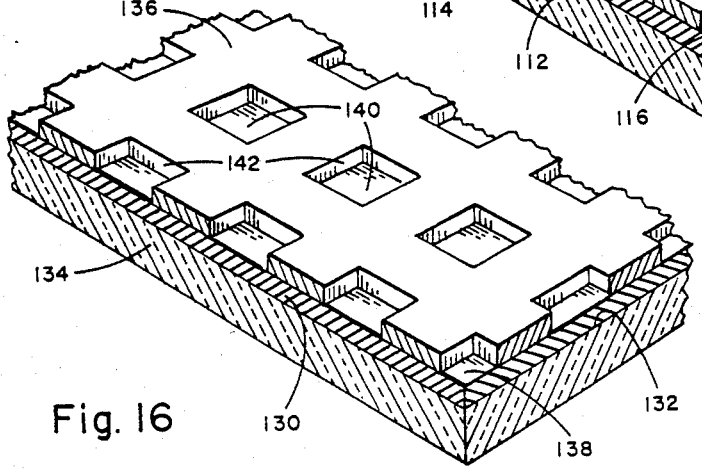
Fig. 16

STORAGE DEVICE HAVING A SEMICONDUCTOR TARGET

BACKGROUND OF THE INVENTION

This is a continuation of application Ser. No. 789,762 filed Jan. 8, 1969, now abandoned.

This invention relates to an information storage device and, particularly, to improvements therein. Information storage tubes of the type described herein may be used with television camera systems, computers, cathode ray systems, and other apparatus.

In some previous storage devices, the storage target therein generally comprises a metal screen having a storage layer of secondary electron-emissive insulating material deposited thereon facing an electron source within the tube. The metal screen acts as a signal electrode for the screen storage target. When the insulating layer is impinged by electrons, emission of secondary electrons therefrom produces a charge pattern on the top surface thereof. The charge pattern is then read by directing a low velocity electron beam toward the storage target, this beam being transmission-modulated by the elemental charges on the storage layer.

With the insulating materials used in the storage targets in the prior art, high target sensitivity has been difficult to achieve due to the relatively high charging capacitance from the signal electrode to the top surface of the storage layer. By decreasing this capacitance the charging and discharging rates of the target are increased, thereby improving the sensitivity and the writing and erasing speeds of the tube. Attempts have been made to decrease the charging capacitance by increasing the thickness of the storage layer deposited on the metal screen. While the capacitance of the screen storage target has been moderately decreased by thickening the storage layer thereof, such a decrease has been at the expense of the electron beam transmissivity of the target. Electron beam transmissivity of a screen storage target is defined as the ratio of the total area of openings of the target to the total area of the screen storage target. In the reading operation, the electron beam is transmitted through the openings in the screen storage target to provide an output of the information stored on the target. Hence, the reduction in electron beam transmissivity detracts from the information reading capabilities of the tube. Such thickening of the storage layer has also introduced problems of wall charging, i.e., charging of the interior walls of the openings in the storage target. Furthermore, such screen storage targets are of limited desirability because of the difficulty of achieving a storage layer of uniform thickness and because, for large targets, the metal screen must be of relatively large mesh strands to provide sufficient strength to support the storage layer, such larger mesh strands further reducing the optical, and hence the electron beam, transmissivity of the target. Also, such targets are of limited resolution because of the mechanical limitations of the mesh size, viz., less than 1200 lines per inch.

Prior art storage targets, including those types other than the mesh type mentioned above, have limited commercial use due to their relatively high charging capacitance values, and consequent low levels of target sensitivity, resulting from the dielectric materials employed in the storage layers, which materials include aluminum oxide, and due to the short information retention times of these targets, which necessitate frequent refreshment of information stored in the target. As mentioned above, where it was sought in the prior art to reduce the capacitance of the target, it was necessary to increase the thickness of the storage layer of the target, but this leads to difficulties in fabrication of the target and lower target resolution. The necessity for refreshing the stored information has required that the storage tube be provided with means, such as a flood gun, for bombarding the storage layer with low velocity electrons.

The refreshment of information stored on the target is as follows. The charge potential at those regions of the target storage layer where a charge image has been "written" by secondary electron emission, is greater than the first crossover potential on the secondary electron emission curve for the particular dielectric material used for the storage layer. The charge potential of the "unwritten" regions of the storage layer is below such first crossover potential. As a result of the flood electrons bombarding the storage target, the charge potential of the "written"regions of the storage layers is driven to a higher voltage stable state while the potential of the "unwritten" regions is driven to a lower voltage stable state. This refreshment thus causes the storage tube to be operated in the bistable mode. Such bistable storage tubes have limited commercial application because no half-tones or gray scales are achieved. That is, the charge pattern of the storage layer is comprised of charge potentials which are at either one or the other of the abovementioned stable state voltages, there being no charge potentials intermediate these voltages. As a result, the storage tube is able to store only binary, and not analog, data. Visual output of information stored in a tube operating in the bistable mode would be in black and white only. The abovementioned shortcomings of short information retention time, necessity to refresh the stored information, and operating in the bistable mode occur, among others, in those storage tubes wherein dielectric phosphor material is employed for the storage regions of the storage target.

SUMMARY OF THE INVENTION

The novel storage tube includes an envelope containing electron gun means and an improved storage target. The storage target is comprised of a substrate (or signal layer) which consists essentially of semiconductor material of substantially single conductivity type, preferably $p^+$, p, or $n^+$ type conductivity silicon or germanium, and a storage layer disposed on (i.e., contiguous to) the substrate and consisting essentially of an insulating compound of a semiconductor material, preferably an insulating compound (e.g., the dioxide or nitride) of the same kind of semiconductor material as that of the substrate. One of the signal layer and the storage layer is interrupted and exposes portions of the other layer. Where the storage layer is interrupted, it covers only a portion of the substrate surface, leaving other portions of the substrate surface exposed. The configuration of the interrupted storage layer may be a continuous network or an ordered plurality of isolated (i.e., discrete) lands e.g., strips.

Some advantages derived from the present invention are the achievability of half-tones, or a broader gray scale, instead of mere bistable operation; lower target capacitance accompanied by relatively thin storage layers and, consequently, increased target sensitivity and increased write and erase speeds; easier target fabrication; improved adherence of the storage layer to the substrate of the target, and improved target resolution.

BRIEF DESCRIPTION OF THE DRAWINGS

FIGS. 13 through 16 are fragmentary perspective views of various embodiments of a storage target employed in the novel storage tube.

DESCRIPTION OF THE PREFERRED EMBODIMENT

Figure 1:
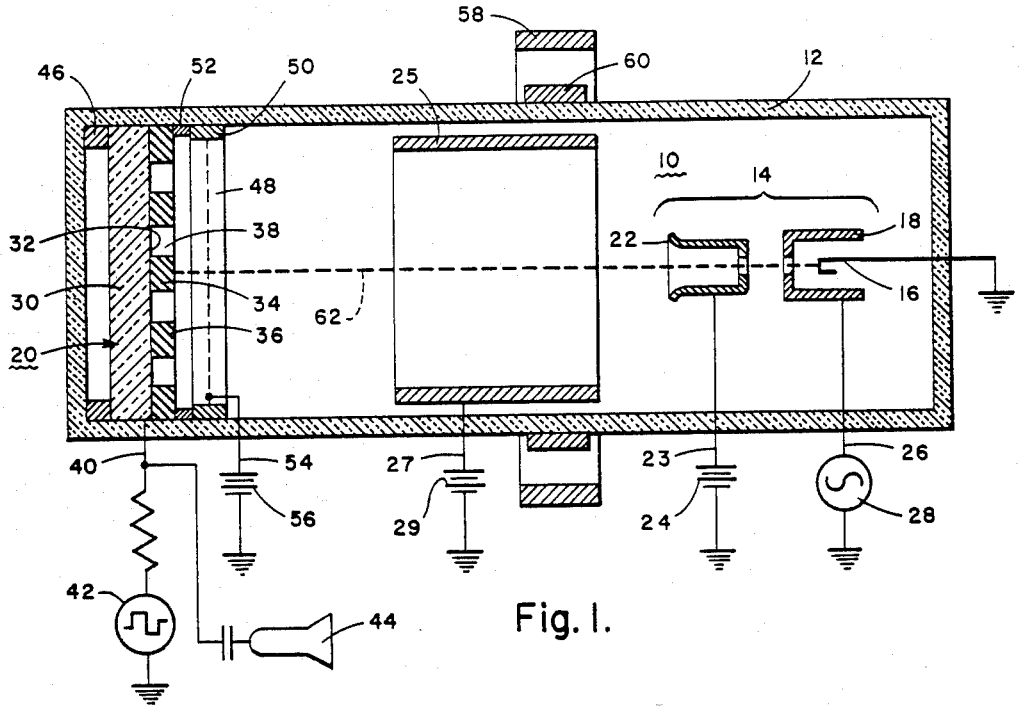
FIG. 1 is a longitudinal sectional view of one embodiment of the novel storage tube.

FIG. 1 illustrates an information storage tube 10 which incorporates the invention disclosed herein. The storage tube 10 is comprised of an evacuated envelope 12, which may be of any suitable material, such as glass. Within the envelope 12 is a single electron gun 14 including a cathode 16, a control electrode 18, an accelerating anode 22, and a focusing electrode 25. A storage target 20 is disposed in the envelope 12 opposite the electron gun 14. The accelerating anode 22 is electrically connected by a lead 23 to a potential source 24 and the control electrode 18 is connected by a lead 26 to a source 28 of input signal which determines the information to be stored on the target 20. The focusing electrode 25 is electrically connected by a lead 27 to a potential source 29. The storage target 20 is schematically shown in FIG. 1 and specific target structures are disclosed in subsequent figures herein.

Figure 2:
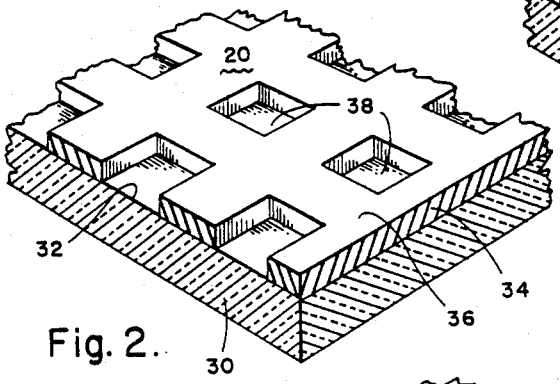
FIGS. 2, 3 and 4 are fragmentary perspective views of various embodiments of storage targets that may be employed in the novel storage tube.

In the preferred embodiment shown in FIG. 2, the storage target 20 is comprised of an uninterrupted semiconductor substrate (or signal layer) 30 having disposed on (i.e., contiguous to) a major surface 32 thereof, a storage layer 34. The substrate 30 consists essentially of a semiconductor material of substantially single conductivity type having an energy band gap value of, preferably, between 0.6 and 1.2 ev. Such semiconductor material is preferably either silicon or germanium, doped to an $N^+$, p, or $p^+$ type conductivity. The polycrystalline or monocrystalline form of either germanium or silicon is satisfactory. The semiconductor substrate 30 is sufficiently thick to provide a self-supporting target structure; for example, 10 mils. The storage layer 34 has a network configuration, which is defined herein as a continuous layer having openings or apertures extending completely therethrough. The storage layer 34 is, by virtue of the apertures 38, an interrupted layer, and covers only a portion of the major surface 32, other portions of the major surface 32 being exposed (i.e., directly accessible) to electrons from the gun 14 via apertures 38 in the storage layer. An "uninterrupted layer" is defined as a layer which is substantially free of openings, apertures, or other interruptions therein. An "interrupted layer" is one having such openings, even though it may be continuous, such as a mesh. Alternatively, an interrupted layer may comprise a plurality of discrete, spaced-apart islands of layer material, in which case it would be discontinuous. The storage layer 34 consists essentially of a secondary electron-emissive insulating compound of a semiconductor material, preferably of that kind of semiconductor material of which the substrate 30 consists. The insulating compound is preferably the dioxide or nitride of either silicon or germanium. As used with respect to the invention herein, the term "layer" includes both a continuous layer and a discontinuous layer comprising an array of separated portions, the latter being exemplified in FIGS. 3 and 4.

Referriing again to FIG. 1, the substrate (or signal layer) 30, which serves as the signal plate of the target 20, is provided with an electrical lead (or other terminal means) 40 whereby both a variable electrical potential from a potential source 42 can be applied to and an electrical output signal (which is generated by electrons that are modulated by a charge pattern on the storage layer, as explained below, and land on the substrate 30) can be extracted from, the substrate 30. The output signal may be transmitted to, for example, a display tube 44 or used in another manner. The storage target 20 is disposed within the storage tube 10 such that the storage surface 36 of the storage layer 34 faces and is substantially perpendicular to the axis of, the electron gun 14. The target 20 is supported in the storage tube 10 by a target support ring 46 or other means known in the art. Between the electron gun 14 and the storage target 20, there is disposed a secondary electron collector electrode 48 supported on a collector support ring 50. The storage target 20 is electrically separated from the collector support ring 50 by an insulating spacer 52. A lead 54 for applying an electrical potential from a potential source 56 is attached to the collector electrode 48. Disposed outside the envelope 12 are magnetic beam-focusing means 58 and magnetic beam-deflecting means 60. Alternatively, electrostatic focusing and deflecting means (not shown) may be used.

Generally, in the operation of the storage tube 10 illustrated in FIG. 1, the electron gun 14 is employed to produce, at different times, any one of a writing beam, a reading beam, or an erasing beam. The cathode 16 of the electron gun 14 is operated at ground potential. The substrate 30 of the storage target 20, acting as a signal plate, is operated at a potential that is determined by the particular operation (viz., write, read, or erase) being carried out, that potential generally being positive with respect to the cathode 16. The focusing means 58 and deflection means 60, respectively, focus the beam 62 and deflect the beam 62 to scan the storage target 20 in raster fashion. In the writing operation, an electron charge image (not shown) is formed on the storage layer 34 as a high velocity writing beam 62 is deflected across the target 20. The electron charge image that is formed is a function of both the storage target potential and the beam current of the writing beam, the former determining the secondary electron emission ratio and the latter determining the number of primary electrons impinging upon and, hence, the number of secondary electrons being emitted by, the storage layer 34. The beam current is modulated by the control electrode 18 in accordance with the potential of signal source 28 applied thereto. Variation of the input signal to the control electrode 18 and, hence, beam current, while the writing beam scans the storage layer 34, causes the various portions of the storage layer surface 36 impinged by the modulated beam to experience different beam currents. Where the target potential exceeds the first crossover potential, those various portions of the storage layer surface 36 which experience different beam currents will emit different quantities of secondary electrons. There will, therefore, be produced on the storage layer 34, variations among the charge potentials of the electron charge image formed thereon, so that the arrangement of the charges comprising the electron charge image will be a function of the input signals provided by the control electrode 18.

In the read operation, the potential of the storage target 20 is established at an appropriate level such that the electrons of a low velocity electron beam are able to land thereon. The low velocity reading beam is deflected in raster fashion, for example, across the storage target 20, the flow of electrons through apertures 38 in the storage layer 34 to the substrate surface 32, being modulated by the charge image formed on the storage layer 34. Thus, where there is a sufficiently high negative charge potential on regions of the storage layer 34 proximate to a given portion of the substrate surface 32, the low velocity reading beam will not be able to impinge upon that surface portion. On the other hand, where the charge potential on certain regions of the storage layer 34 is sufficiently less negative or is of zero potential, at last a portion of the reading beam will be able to impinge upon those portions of the substrate surface 32 in proximity with those regions of the storage layer 34. Those electrons from the reading beam which do land on the various portions of the substrate 30 provide an electrical readout, or output signal, of the charge image on the storage layer 34 in accordance with the arrangement of the charges which constitute the charge image.

Figure 3:
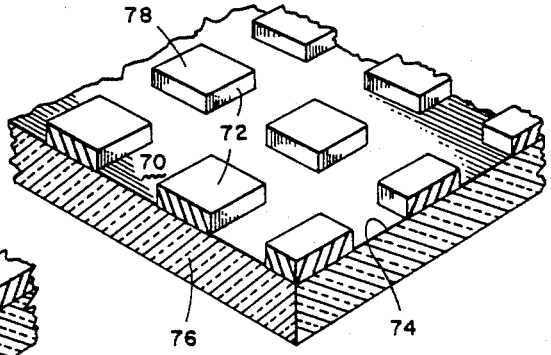

In another embodiment of the invention shown in FIG. 3, a storage tube of the type shown in FIG. 1 employs a storage target 70 comprising a storage layer 72 disposed on a major surface 74 of an uninterrupted semiconductor substrate 76, the storage layer 72 comprising an ordered array of separate, or discrete, lands 78 (FIG. 3). In another embodiment of the invention shown in FIG. 4, a storage tube of the type shown in FIG. 1 employs a storage target 80 having a storage layer 82 comprising a plurality of lands that comprise substantially parallel strips 84. The storage layer 82 is disposed on major surface 86 of an uninterrupted semiconductor substrate 88. In both embodiments (FIGS. 3 and 4), the storage layers 72 and 82 cover only a portion of the respective major surfaces 74 and 86, the exposed portions of the major surfaces 74 and 86 being accessible to the electron beam 62. The storage target shown in FIG. 4 is disposed such that the scanning direction of the beam 62 is preferably substantially perpendicular to the major axes of the strips 84.

Figure 4:
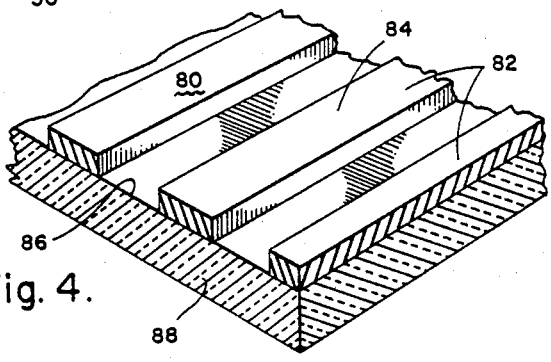

In all the embodiments of FIGS. 2, 3, and 4, the semiconductor substrates or signal layers (30, 76, and 88, respectively), as previously stated, preferably consist essentially of silicon or germanium having an n+ type, p type, or p+ type conductivity and the storage layers (34, 72, and 82, respectively) preferably consist essentially of an insulating compound (e.g., the dioxide or nitride) of the kind of semiconductor material of which the substrate consists. The storage target may be made by techniques known in the art. For example, the storage layer 34 (FIG. 2) is produced by, first, providing on the substrate 30 an uninterrupted layer (not shown) of an insulating compound of the semiconductor material used for the substrate 30. Where the semiconductor material of the substrate is silicon and the insulating compound thereof is silicon dioxide, the above-mentioned uninterrupted layer of insulating compound is produced by, for example, one of the well-known techniques of thermal oxidation of the substrate in steam, chemical vapor deposition from a mixture of silane and oxygen; or anodic oxidation. Where the storage layer 30 is made of silicon dioxide, a layer thickness of less than 3.0 microns is preferred for ease of fabrication. However, the thickness of the storage layer is not critical, a broad range of thicknesses extending above 3.0 microns being satisfactory. After the uninterrupted insulating layer is deposited, apertures 38 are produced in that layer by photoresist methods known in the art. The apertures 38 extend completely through the uninterrupted layer (thus providing the interrupted layer 34) such that the major surface 32 of the substrate 30 is accessible, through the apertures 38, to an electron beam. While the apertures 38 are shown to be rectangular, apertures having other configurations, such as circular, elliptical, etc. are satisfactory. The storage target thus fabricated may now be mounted on suitable means, such as a target support ring 46 (FIG. 1), by an adhesive or in some other suitable manner. Thereafter, the mounted target is disposed within the envelope 12 (FIG. 1) as by bonding the target support ring 46 to the envelope walls by means of adhesive, for example.

FIGS. 5 through 12 schematically illustrate the storage target 20 of FIG. 1 at various phases (viz., write, read, and erase) of one mode of operating the storage tube 10 of FIG. 1. This mode includes "writing" on the storage target 20 by causing emission of secondary electrons from the storage layer 34 of the target 20. The storage target 20 shown in FIGS. 5 through 12 comprises both a semiconductor substrate 30 consisting essentially of silicon of the desired conductivity type, for example, and a storage layer 34 consisting essentially of silicon dioxide, for example. The storage layer 34 is comprised, for purposes of illustration, of insulating regions A, B, C, and D. Illustrative charge potential values for the respective insulating regions are provided thereabove in FIGS. 5 through 12. In FIGS. 5 through 12, all target potentials ($V_t$) applied to the semiconductor substrate are with respect to the potential of the cathode 16.

Figure 5:
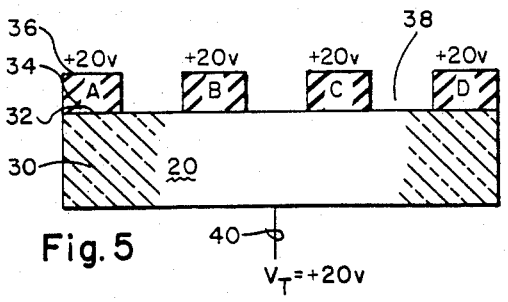
FIGS. 5 through 12, inclusive, are schematic sectional views through the target to explain various phases of a mode of operating one embodiment of the novel storage tube.

Referring now to FIG. 5, without any electron beam impinging upon the target 20, there is first applied to the semiconductor substrate 30 a target potential ($V_t$) of +20 V. This applied potential brings about a charge of +20 V. at the top surface 36 of the storage layer 34. This charge on the storage layer 34 is brought about by capacitive coupling between that substrate major surface 32 on which the storage layer is disposed and the top surface 36 of the storage layer 34. While maintaining a +20 V. potential on the semiconductor substrate 30, the electron gun 14 is turned on and the produced electron beam 62 is caused, by deflection means 60, to scan the target 20 and, hence, the storage layer 34 thereon.

Figure 6:
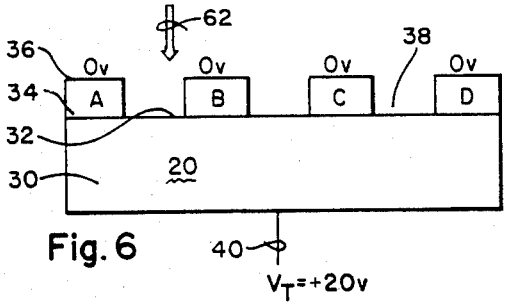
Figure 7:
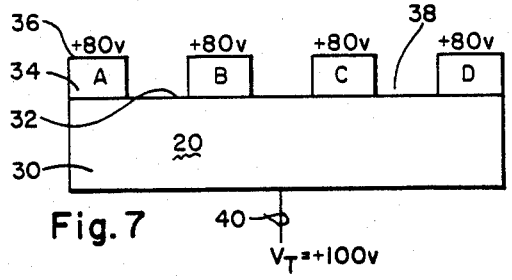

Because of the aforementioned positive charges existing on the storage layer 34, electrons from the beam 62 land on the storage layer 34 in sufficient quantities to reduce to zero volts the charge potential of the storage layer 34, as shown in FIG. 6. Thereafter, the beam is turned "off" and the applied target potential ($V_t$) is increased to +100 V. as shown in FIG. 7. This 80 V. increase in target potential causes a corresponding increase (i.e., to +80 V.) in the charge potential on the storage layer 34 by virtue of capacitive coupling. The amount of the increase in the target potential should be sufficient to cause the charge potential on the storage layer 34 to be increased to a level exceeding the first crossover potential on the secondary emission curve for the particular insulating material used for the storage layer 34. For charge potentials exceeding the first crossover potential, the secondary electron emission ratio will exceed unity. For a silicon dioxide layer, the first crossover potential is below +50 volts with respect to cathode potential.

Figure 8:
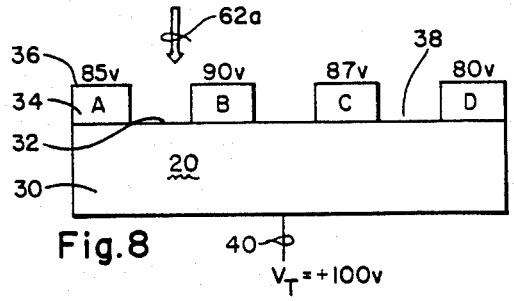

Referring now to FIG. 8, the electron gun 14 is then turned on and a high velocity writing beam 62*a* is caused to scan the target 20 while the target potential is maintained at +100 V. Because the storage layer 34 has a charge potential (i.e., +80 V.) exceeding the first crossover potential value for a silicon dioxide layer, secondary electrons can be emitted, at a secondary-to-primary ratio greater than one, from the storage layer 34 as that layer is scanned by the beam. The number of secondary electrons emitted is dependent upon the beam current, which is modulated, as stated before, by the input signal to the control electrode 18 of the electron gun 14.

Because of the modulation of the electron beam current by the input signal to the control electrode 18, some portions A, B, C, but not others D, of the storage layer 34 impinged by the beam exhibit, as shown in FIG. 8, an increase in the charge potential thereon (to +85, +90, and +87 V., respectively). This is due to more secondary electrons leaving the storage layer 34 at these portions than the primary electrons arriving thereat. That is, in this particular case, as the target 20 is scanned, the input signal so modulates the beam current that quantities of secondary electrons sufficient to provide distinguishable changes in charge potential, are emitted by portions A, B, and C but not by portion D. The variations in charge potential among portions A, B, and C are due to the different quantity of secondary electrons emitted by each, this difference being caused by the different level of beam current existing as the beam scans each portion A, B, and C. The increased level of charge potential is preferably at least 10 V. below that of the target potential, this to achieve nondestructive readout. The collector electrode 48 is maintained at a potential of, for example, +500 V. with respect to the cathode potential, thereby collecting secondary electrons emitted from the target 20.

Figure 9:
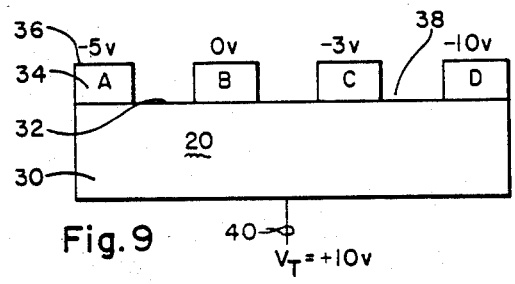

Thereafter, the beam is turned off and the applied target potential is reduced by a value of at least equal to the highest charge potential (i.e., about 90 V.) existing on the storage layer, as shown in FIG. 9. As a result, the applied target potential ($V_t$) in this situation is no greater than 10 V. Because of capacitive coupling, the charge potentials on the storage layer 34 are reduced by a value (i.e., about 90 V.) corresponding to the reduction in applied potential. Consequently, the charge potentials on the storage layer 34 are either negative or zero. At this stage, writing has been completed and information stored in the target in the form of a charge pattern, may be read.

Figure 10:
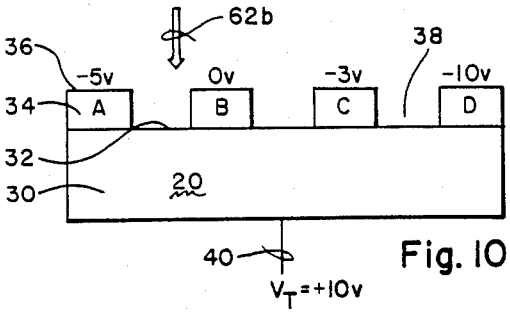

In the reading operation shown in FIG. 10, while the applied target potential ($V_t$) is maintained at +10 V., the electron gun 14 is turned on to provide a low velocity reading beam 62*b* which scans the target 20 in raster fashion. The amount of the beam 62*b* which will pass through the apertures 38 in the insulating layer 34 to a particular portion of the substrate major surface 32 will be related to the charge potential of the storage layer regions surrounding that particular portion. The electrons of the reading beam 62*b* will have difficulty in landing on those exposed portions of the substrate major surface 32 which are surrounded by those regions of the storage layer 34 having relatively high negative charge potential. Where the charges on the storage layer 34 are not so highly negative or are of zero potential, beam electrons are more able to land on the substrate major surface 32. Hence, the electron flow through the apertures 38 in the storage layer 34 is modulated by the charge pattern formed on the storage layer 34. Electrons landing on the substrate 30 generate an output signal which is extracted and transmitted to a remote display tube 44 for visual display or utilized in some other manner. Reading in the above mode is done nondestructively. Because the storage target 20 has very long information retention capability, the stored information may be read many times without changing significantly the charge pattern stored in the target.

Figure 11:
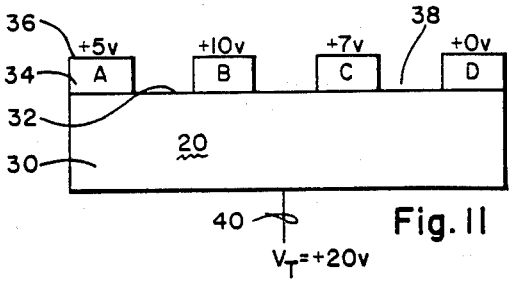
Figure 12:
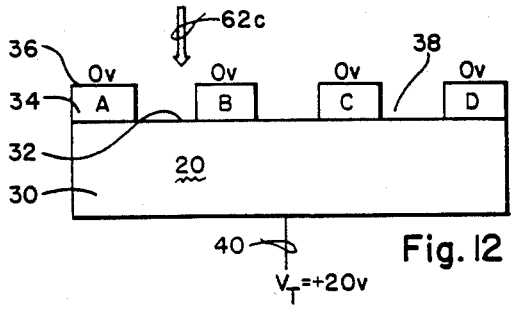

Referring now to FIG. 11, when it is desired to erase the stored information, the target potential ($V_t$) is increased to a value (about +20 V.) that will, by capacitive coupling, raise the charge potential on all points on the storage layer 34 to at least ground potential (i.e., at least zero volts with respect to the cathode potential). This increase in target potential is done without any electron beam impinging upon the target 20. Then, while the target potential ($V_t$) is maintained at this level, as shown in FIG. 11, an erasing beam 62*c* is produced, the beam 62*c* providing electrons which will land upon the storage layer 34, which is positively charged (as shown in FIG. 11). Such landing of electrons causes the storage layer 34 to charge down to a zero charge potential with respect to cathode potential as shown in FIG. 12. The storage target 20 is now again available for information storage and the above steps may be repeated.

In the novel target, writing and erasing functions are satisfactorily executed in a single scanning frame, this high speed being attributable to the improved sensitivity and dielectric properties of the target. The above-described mode of operation is merely illustrative, the invention disclosed herein being operable by other modes known in the art, these other modes employing destructive or non-destructive readout. With the above-described mode of operation or with others known in the art, the novel storage target may be used with a display tube to produce "halftone" images. A "halftone" image is defined as one including a continuously varying range of gray tones, as well as black and white.

FIG. 13 illustrates another embodiment of the invention wherein those areas of the major surface 90 of the uninterrupted target semiconductor substrate (or signal layer) 92 which are not covered by the interrupted storage layer 94, are alloyed at regions 96 with a material which will inhibit oxidation thereat. Oxidation of exposed areas of the major surface 90 is undesirable because it interferes with electron beam interception by these exposed areas, thus hindering the "reading" operation of the storage tube. This embodiment further improves the results obtained with the embodiments in FIGS. 2, 3, and 4 by minimizing surface oxidation of the semiconductor substrate. Materials which may be used for inhibiting oxidation include gold, silver, tungsten, molybdenum, platinum, and nickel. Alloying may be done by techniques known in the art, such as sputtering, for example. The thickness of the alloyed regions 96 may be 1000 Angstroms, for example. While the storage layer 94 illustrated is of a network configuration, such alloying may be done regardless of the storage layer configuration.

FIG. 14 illustrates still another embodiment of the novel storage target. In this embodiment, semiconductive lands 100 consisting of the same material (e.g., essentially $p^+$, p, or $n^+$ type conductivity silicon or germanium, as the case may be) as the uninterrupted semiconductor substrate (or signal layer) 102, are disposed on and in electrical connection with those areas of the substrate major surface 104 which are not covered by the interrupted storage layer 106. The semiconductive lands 100 extend to and cover only a portion of the top surface 108 of the storage layer 106 at those regions which surround the respective areas of the major surface 104. The semiconductive lands 100 provide an increased beam landing area over the embodiments illustrated in FIGS. 2, 3, 4, and 13. This increased beam landing area improves the ability of an electron beam to impinge upon the storage target (FIG. 14), further enhancing the operation of the storage tube. The charge pattern is stored on the exposed regions of the top surface 108 of the storage layer. Such semiconductive lands 100 may be produced by techniques known in the art, including chemical deposition of an uninterrupted semiconductor film (not shown) by the pyrolysis of silane, followed by selective removal from the semiconductor film by photoresist methods. The storage layer 106 consists essentially of an insulating compound, such as a nitride or dioxide, of a semiconductor material, preferably the same kind of semiconductor material as the substrate 102. While FIG. 14 illustrates a storage layer 106 of network configuration, semiconductive lands may be used with storage layers of other configurations.

FIG. 15 illustrates still another embodiment of the novel storage target herein. In this embodiment there is disposed on a major surface 110 of a substrate 112 of semiconductor material, an uninterrupted storage layer 114 of an insulating compound of a semiconductor material. The storage layer 114 on the substrate 112 may be fabricated by the methods indicated above. On the exposed major surface 116 of the storage layer 114, is disposed an interrupted conducting layer (which acts as a signal plate) 118 having a network configuration or some other configuration wherein the various portions are in electrical connection with each other (i.e., continuous). The conducting layer (or signal layer) 118 is made of, for example, metal or semiconductor material (e.g., p, $p^+$, or $n^+$ type conductivity silicon or germanium) and has a thickness of, for example, 2000 Angstroms. One method of producing a conducting layer 118 of silicon, for example, is decomposition of silane and subsequent selective removal from the conducting layer by photoresist techniques known in the art. The conducting layer 118 covers only a portion of the major surface 116 and has peripheral portions 120 extending to and in electrical connection with the semiconductive substrate 112. By providing connecting means (not shown) to either the substrate 112 or the conducting layer 118, electrical potential may be simultaneously applied to both. Such target potential will cause the substrate 112 and the conducting layer 118 to produce a charge potential on the major surface 116 of the storage layer 114. The substrate 112 produces such a charge potential by a parallel plate capacitive effect between the major surface 110 thereof and the major surface 116 of the storage layer 114. The conducting layer 118 produces such charge potential by fringe field capacitive effect between the exposed areas 122 of the major surface 116 of the storage layer 114 and the respective adjacent wall regions 124 of the conducting layer 118. This embodiment (FIG. 15) is particularly advantageous where a thicker (for example, greater than 3 microns) storage layer is provided in order to achieve still lower levels of target capacitance and higher writing speeds than the already-enhanced characteristics provided by the targets discussed above. Where the thickness of the storage layer is greater than about 3 microns, it is difficult to provide, by photoresist methods, apertures or other openings in the storage layer in order to make the semiconductor substrate accessible to the electron beam. This is because the etching of such thick storage layers does not result in openings with side walls substantially normal with the substrate but, instead, results in openings whose side walls slope toward the center of the opening. Such sloping walls are undesirable because they reduce the beam landing area of the target substrate and cause higher target capacitance, thereby detracting from target resolution and performance. By utilizing the target embodied in FIG. 15, a target having a relatively thick storage layer and consequent lower capacitance, may be produced without the problems of reduced electron beam transmissivity encountered in the prior art in providing a thick storage layer to a screen storage target.

FIG. 16 illustrates still another embodiment of the novel storage target wherein an uninterrupted storage layer 130 is disposed on a major surface 132 of a semiconductor substrate 134. An interrupted signal plate conducting layer 136, of a network or other continuous configuration where all portions of the layer are electrically interconnected, is disposed on the upper surface 138 of the storage layer 130. The structure and materials of the target in FIG. 16 are similar to those of FIG. 15 except that the conducting layer 136 is electrically independent of the semiconductor substrate 134. The substrate 134 and the conducting layer 136 each operates as independent electrodes to which a target potential is applied from a potential source (not shown) via separate connecting means (not shown) provided to each. The capacitive coupling between the substrate major surface 132 and the upper surface 138 of the storage layer 130 is by parallel plate capacitance whereas that between the exposed areas 140 of the storage layer 130 and the respective adjacent wall regions 142 of the conducting layer 136 is by fringe field capacitance. Because the substrate 134 and conducting layer 136, operating by capacitive coupling with the upper surface 138 of the storage layer 130, are able to produce, independently of each other, charge potentials on the upper surface 138, they provide two independent means for controlling such charge potential. By adjusting the relative geometries of the substrate 134 and the conducting layer 136, one of these may be caused to have a lower capacitive effect so that that particular one is useable as a fine control while the other one is useable as a coarse control for the target. This provides improved tube performance. In the embodiments illustrated in FIGS. 15 and 16, the charge pattern is stored on the exposed areas 122 and 140, respectively, of the respective storage layers 114 and 130, while the reading beam impinges upon the respective conducting layers 118 and 136, from which conducting layers the output signal is extracted.

The invention disclosed herein provides several advantages and unexpected results over the prior art. The novel targets unexpectedly provide an advantageous combination of improved charge retention capability and relatively low capacitive values with relatively thin storage layers. Because of the high charge retention capability of the insulating compounds employed in the novel targets, halftone information may be produced so that analog data, and not merely binary data, can be stored. Hence, a visual output of the stored information can include a broad gray scale in addition to black and white. Furthermore, the high charge retention capability of the storage target allows information to be stored for greatly extended periods of time without refreshment of the information. Thus, it is unnecessary to provide a flood gun or other means for refreshing and to expend operating time to refresh the target. The relatively low capacitive values of the target provide for higher target sensitivity and, therefore, higher writing and erasing speeds, single scanning frames being sufficient to write or to erase. The relative thinness of the storage layer, as well as the particular materials used herein enable the novel storage tubes to have storage targets of higher resolution and higher fineness of detail than previous tubes.

I claim:

1. An electron device having information storage capabilities, comprising:

a. an evacuated envelope;

b. a storage target disposed within said envelope comprising semiconducting regions and storage regions alternating across an exposed major face of said target, said semiconducting regions being surface portions of a continuous layer of semiconductor material of substantially single conductivity type and said storage regions consisting essentially of a discontinuous layer of an insulating compound of semiconductor material; and c. means for writing information on said storage target, for reading said information, and for erasing said information.

2. The electron device defined in claim 1, wherein said storage regions are secondary emissive, and said device further comprises:

a. terminal means connected to said storage target for applying electrical potential thereto and extracting electrical signals therefrom;

b. a collector electrode for intercepting secondary electrons emitted from said target, said collector electrode being disposed in spaced relation with said storage target; and c. terminal means for applying electrical potential to said collector electrode.

3. An electron device having information storage capabilities, comprising:

a. an evacuated envelope;

b. a self-supporting storage target disposed within said envelope, comprising i. a signal layer consisting essentially of semiconductor material of substantially single conductivity type and having an energy bandgap of between 0.6 ev. and 1.2 ev., said signal layer having a major surface, and ii. a secondary electron emissive storage layer disposed contiguous to said major surface, said storage layer consisting essentially of an insulating compound of semiconductor material, one of said layers being interrupted and exposing portions of the other layer;

c. terminal means connected to said signal layer for applying electrical potential thereto and for extracting electrical signals therefrom;

d. an electron gun disposed within said envelope in spaced relation with and opposite said storage layer;

e. a collector electrode disposed between and in spaced relationship with said electron gun and said storage target, said collector electrode being disposed to intercept secondary electrons emitted from said storage target; and f. terminal means for applying electrical potential to said collector electrode.

4. An electron device having information storage capabilities, comprising:

a. an evacuated envelope;

b. a storage target disposed within said envelope, comprising:

i. a substrate consisting essentially of semiconductor material of substantially single conductivity type and having a major surface, and ii. a plurality of discrete storage elements disposed upon said major surface and spaced apart to expose portions of said substrate, said elements consisting essentially of an insulating compound of semiconductor material; and c. means for writing, reading, and erasing information on said storage target.

5. An electron device having information storage capabilities, comprising:

a. an evacuated envelope;

b. a storage target disposed within said envelope including a signal layer consisting essentially of semiconductor material of substantially single conductivity type and a storage layer disposed contiguous to said signal layer, said storage layer comprising an insulating compound of semiconductor material, one of said layers being discontinuous and exposing portions of the other layer; and c. means for writing, reading, and erasing information on said target.

6. The electron device defined in claim 5 wherein said semiconductor material is silicon.

7. The electron device defined in claim 5 wherein said insulating compound is silicon dioxide.

8. The electron device defined in claim 5 wherein said insulating compound is silicon nitride.

9. The electron device defined in claim 5 wherein said semiconductor material is germanium.

10. The electron device defined in claim 5 wherein said semiconductor material of said insulating compound is the same kind of semiconductor material as that of said signal layer.

11. The electron device defined in claim 5 wherein said semiconductor material of said insulating compound is a different kind of semiconductor material from that of said signal layer.

12. An electron device as defined in claim 5, wherein said storage layer is secondary electron-emissive, and said means for writing information comprises:

a. electron gun means for directing impinging electrons onto said target, thereby causing secondary electrons to be emitted from said storage layer; and b. means for collecting said secondary electrons.

13. The electron device of claim 5, wherein said signal layer is polycrystalline.

14. The electron device of claim 5, wherein said signal layer is substantially monocrystalline.

15. The electron device defined in claim 5 wherein said storage layer is discontinuous and comprises an ordered plurality of discrete lands.

16. The electron device defined in claim 15 wherein said lands comprise an array of substantially parallel strips.

17. The electron device defined in claim 5 wherein said storage layer is discontinuous and an oxidation-inhibiting material is alloyed with said signal layer at exposed areas of said major surface.

18. The electron device defined in claim 17 wherein said oxidation-inhibiting material is selected from the group consisting essentially of silver, gold, platinum, molybdenum, tungsten and nickel.

19. The electron device defined in claim 5, wherein said other layer is uninterrupted.

20. An electronic storage tube including a target which is comprised of a pattern including a plurality of alternating discrete insulating strips and conducting strips, the tube comprising:

means for applying a signal to the target to establish a desired stored charge distribution on the discrete insulating strips; and means for detecting the stored charge distribution on the target, and wherein the conducting strips are electrically connected to each other and are formed of silicon; and the discrete insulating strips are formed of silicon dioxide.

21. The invention of claim 20 wherein the pattern comprising said plurality of discrete insulating strips overlies a conducting substrate.

22. The invention of claim 20, including a conducting substrate of silicon and discrete insulating strips overlying the conducting substrate such that the pattern comprises said plurality of alternating discrete insulating strips and conducting strips.

23. An electronic storage tube comprising:

a target having a pattern of alternating conducting strips and discrete insulating strips;

an output terminal, the conducting strips being electrically connected to the output terminal;

means for applying an input signal to the target such that a signal is stored thereon in the form of a desired stored charge distribution on the insulating strips;

means for scanning the target and obtaining an output signal at the output terminal which output signal is a function of the stored charge distribution on the insulating strips; and wherein the conducting strips are formed of silicon; and the insulating strips are formed of silicon dioxide.

* * * * *

UNITED STATES PATENT AND TRADEMARK OFFICE

CERTIFICATE OF CORRECTION

PATENT NO. : 4,490,643

DATED : December 25, 1984

INVENTOR(S) : Robert S. Silver

It is certified that error appears in the above-identified patent and that said Letters Patent is hereby corrected as shown below:

Column 6, Line 2 - "30" should be -- 34 -- .

Signed and Sealed this

*Twelfth* Day of *November 1985*

[SEAL]

*Attest:*

DONALD J. QUIGG

*Attesting Officer*

*Commissioner of Patents and Trademarks*